US005175979A

United States Patent [19]

van der Werff et al.

[11] Patent Number: 5,175,979

[45] Date of Patent: Jan. 5, 1993

[54] APPARATUS AND METHOD FOR REMOVING CONTENTS FROM AN ENVELOPE

[75] Inventors: Jeichienus A. van der Werff, Montfoort; Eric van der Vegte, Drachten, both of Netherlands

[73] Assignee: Hadewe B.V., Drachten, Netherlands

[21] Appl. No.: 707,788

[22] Filed: May 30, 1991

[30] Foreign Application Priority Data

May 30, 1990 [NL] Netherlands ..... 9001238

[51] Int. Cl.[5] ..... B65B 43/26

[52] U.S. Cl. ..... 53/492; 53/381.3

[58] Field of Search ..... 53/492, 381.3, 381.2, 53/381.5, 381.7, 381.1; 414/412, 411

[56] References Cited

U.S. PATENT DOCUMENTS

| | | | |
|---|---|---|---|
| 3,116,718 | 1/1964 | Krupotich et al. . | |
| 3,143,100 | 8/1964 | Krupotich . | |
| 3,238,926 | 3/1966 | Huck . | |
| 3,691,726 | 9/1972 | Stephens et al. | 53/381.3 |
| 3,884,010 | 5/1975 | Bardo et al. | 53/53 X |
| 4,016,708 | 4/1977 | DeHart | 53/381.3 |
| 4,113,105 | 9/1978 | DeHart et al. | 209/549 |
| 4,139,977 | 2/1979 | Russell | 53/77 |
| 4,233,800 | 11/1980 | Long et al. | 53/381 R |
| 4,893,454 | 1/1990 | Russell | 53/492 |
| 4,909,021 | 3/1990 | Barbour | 53/492 |

FOREIGN PATENT DOCUMENTS

| | | |
|---|---|---|
| 0048485 | 3/1982 | European Pat. Off. . |
| 0108465 | 5/1984 | European Pat. Off. . |
| 2135481 | 12/1972 | France . |
| WO88/01543 | 3/1988 | World Int. Prop. O. . |

*Primary Examiner*—James F. Coan

*Attorney, Agent, or Firm*—Burns, Doane, Swecker & Mathis

[57] ABSTRACT

An apparatus and method for removing contents from an envelope are disclosed. In the apparatus a front envelope wall is severed from a rear envelope wall along three of the folding edges, the envelope is separated from its contents and finally the separated envelope is removed along an exit track. The exit track passes along the outer side of the apparatus and is at least in part externally visible. The envelope is transferred to said exit track in an unfolded condition and transported along the exit track with its former inner surfaces of the envelope walls turned away from the apparatus. The invention provides a possibility to check visually in a simple and efficient manner whether the contents of an envelope have been removed completely.

25 Claims, 2 Drawing Sheets

APPARATUS AND METHOD FOR REMOVING CONTENTS FROM AN ENVELOPE

BACKGROUND OF THE INVENTION

The invention relates to an apparatus for removing contents from an envelope comprising a front wall and a rear wall connected to said front wall along four folding edges, which apparatus comprises means for severing said front wall from said rear wall along three of the folding edges, means for separating the envelope from its contents and conveying means for discharging the separated envelope.

The invention further relates to a method for removing contents from an envelope by means of an envelope extraction apparatus, said envelope having a front wall and a rear wall interconnected along four folding edges, in which said front wall is severed from said rear wall along three of the folding edges, the envelope is separated from its contents and the separated envelope is discharged along an exit track.

An apparatus and method as described are known from PCT patent application published under number WO-88/01543.

A problem in machine removal of an envelope from its contents is that so far it has proved impossible in practice to ensure that under no circumstances parts of the contents are removed along with the envelope. Therefore in the known apparatus means for measuring the thickness of the envelope walls and of parts of the contents are provided for monitoring whether exclusively the envelope has been removed.

A drawback of monitoring through the measurement of thickness is that processing in a random order of postal items that are mutually different as regards the thickness of the envelopes, of the contents or of the parts of which the contents are composed is impossible.

A further drawback of measuring the thickness is that it requires expensive measuring instruments.

OBJECTS OF THE INVENTION

Accordingly it is an object of the present invention to provide an improved apparatus and method which permit processing in a random order of postal items that are mutually different as regards the thickness of the envelopes, of the contents or of the parts of which the contents are composed, with reliable monitoring of each removed envelope.

It is a further object of the present invention to provide an apparatus and method which enables a simple manner of checking whether along with an envelope any corresponding contents or at least parts thereof have been removed.

SUMMARY OF THE INVENTION

This object is achieved in accordance with the invention disclosed herein by providing an apparatus of the above described type in which the exit track passes along the outer side of the apparatus and is at least in part externally visible, and the means for separating the envelope from its contents comprise means for unfolding said front envelope wall from said rear envelope wall and means for transferring the envelope to said exit track in an unfolded condition and in a position from which the envelope can be transported along the exit track with its former inner surfaces of the envelope walls turned away from the apparatus.

The front envelope wall is unfolded from the rear envelope wall and the envelope is discharged in an unfolded condition and in an orientation in which the former inner surfaces of the envelope walls are turned away from the envelope extraction apparatus.

Since the envelope is integrally removed with its former inner sides turned away from the apparatus, a single quick visual inspection of each envelope is sufficient to establish whether along with that envelope any contents are being removed. This in turn enables processing in a random order of postal items with contents that are mutually different as to the dimensions of the envelopes, of the contents or of parts of which the contents are composed.

Even in fields of use where it may be assumed that the envelopes and their contents are of constant thickness, for instance in the processing of payment orders or forms in return envelopes, the incoming envelopes in practice prove to contain considerable quantities of irregular material. When an apparatus according to the invention is used, checking the envelopes may efficiently be combined with the manual selection and sorting of such irregular material.

The invention will now be further explained and illustrated with reference to some embodiments as shown in the accompanying drawings.

DETAILED DESCRIPTION OF THE PREFERRED EMBODIMENT

In the following description an envelope with its contents is referred to as a postal item. It will be clear, however, that the embodiments can also be used in the processing of envelopes with contents that are despatched in ways other than by post (for instance by courier or as interoffice mail).

Figure 1:
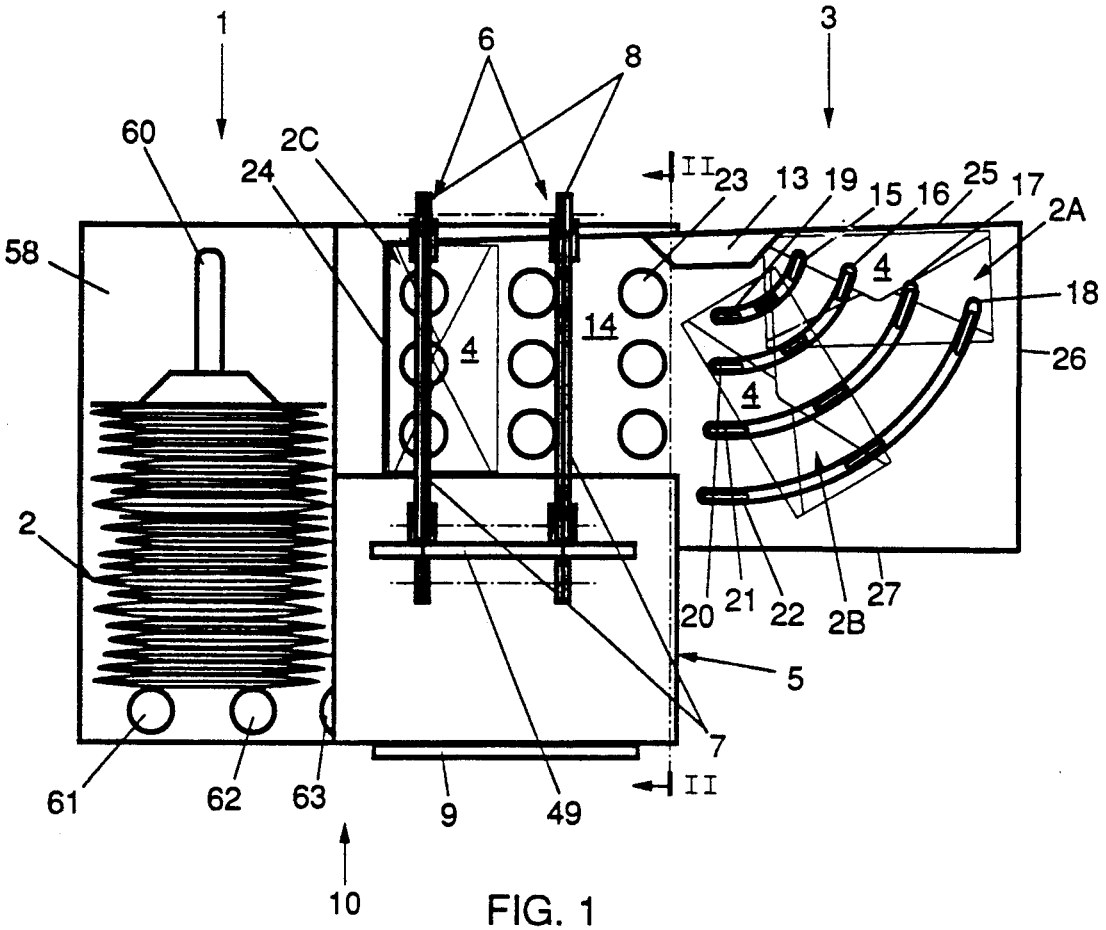
FIG. 1 is a top elevational view of a first embodiment of the apparatus according to the invention.
Figure 2:
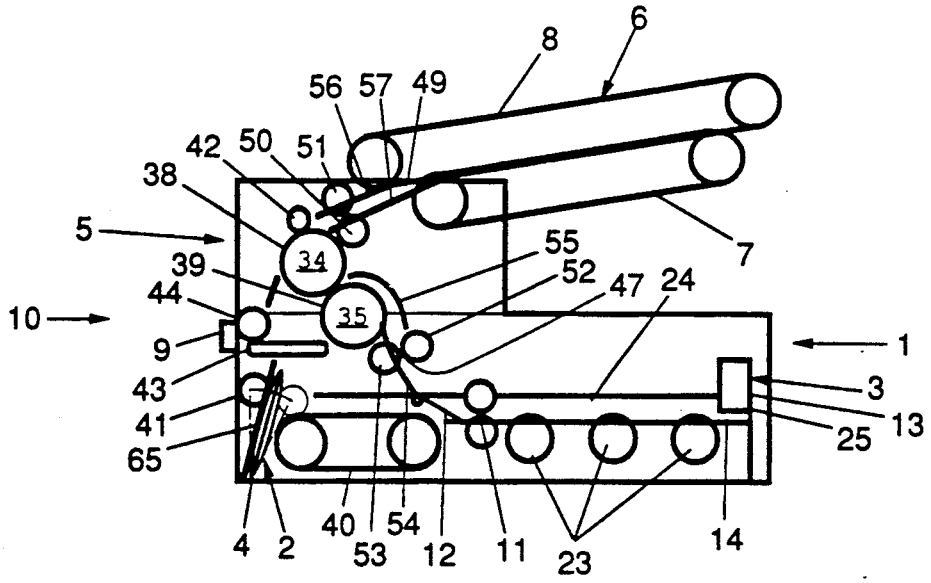
FIG. 2 is a sectional side elevational view of the apparatus according to FIG. 1 taken on the line II—II.
Figure 3:
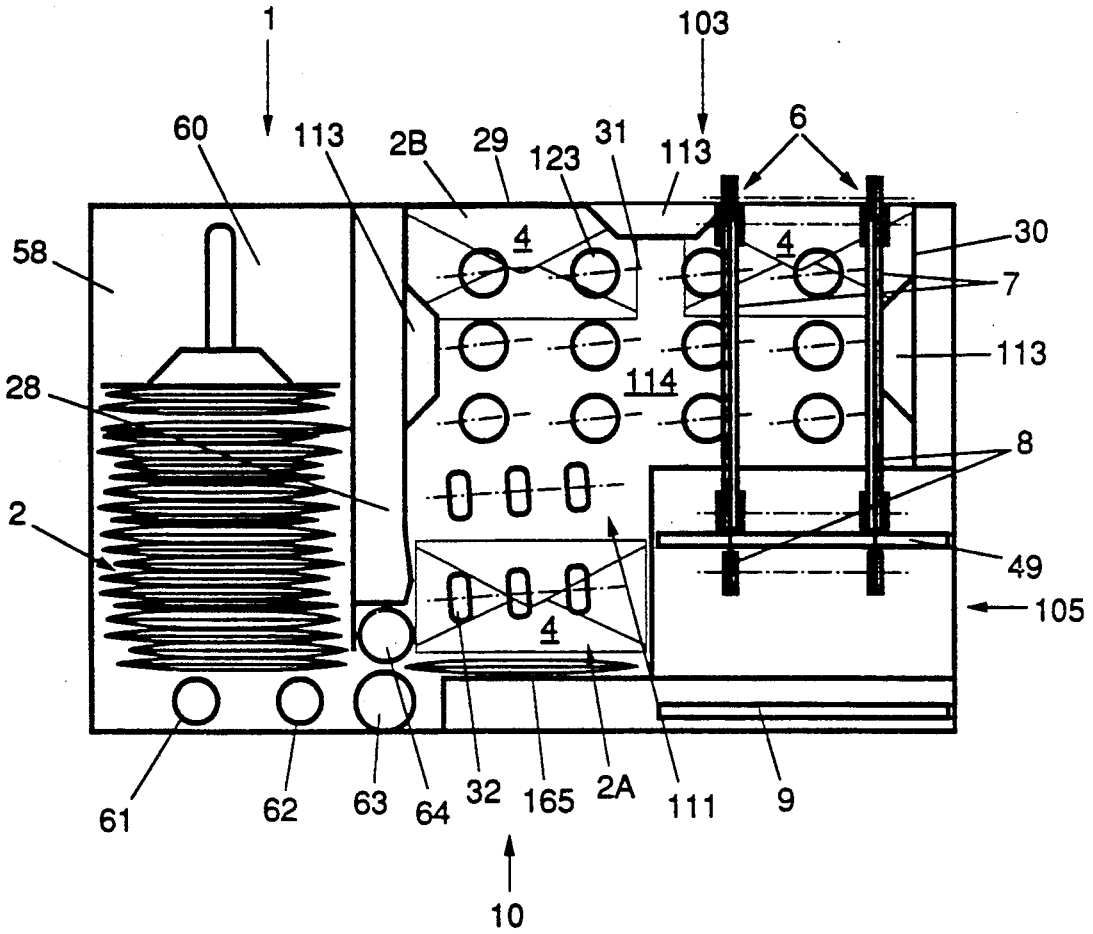
FIG. 3 is a top elevational view of a second embodiment of the apparatus according to the invention.

FIGS. 1 and 2 show a first embodiment of an apparatus according to the invention. FIG. 3 shows a second embodiment which is presently the most preferred embodiment.

The embodiments of the apparatus according to the invention each comprise three main processing stations. First, a holder station 1 for accommodating and supplying piece by piece postal items 2 to be processed. Second, a station 3, 103 for separating a front wall and a rear wall of an envelope 4 from each other along three of the folding edges of the envelope 4. Third, a station 5, 105 for separating the envelope 4 from its contents. Instead of the station 1 for accommodating and supplying piece by piece postal items to be processed, an opening may be provided, for instance, for feeding by hand the postal items to be processed piece by piece.

Connected to the station 5, 105 for separating the envelope 4 from its contents is an exit track 6 for removing separated envelopes.

The exit track 6 is mounted on the outer side of the apparatus. The station 5, 105 for separating the envelope 4 from its contents comprises means for unfolding the envelope 4 and means for transferring the envelope 4 to the exit track 6 in an unfolded position such that the envelope 4 can be discharged with the former inner sides of the envelope walls turned away from the apparatus. The exit track 6 is in part visible externally.

On account of the fact that the exit track 6 is mounted on the outer side of the apparatus and a part thereof is visible externally, the envelopes 4 which are being discharged along that exit track 6 are visible to an operator of the apparatus for some time. Since the envelope 4 is removed from its contents in unfolded condition and is removed with its former inner sides turned away from the apparatus, it can be observed very readily and quickly whether along with the envelope parts of its contents are being discharged. Because the envelope is discharged in its integrity, checking requires inspecting only one piece, which requires a minimum of time.

It is advantageous if the time during which the envelope can be inspected and, if necessary, can be intercepted is as long as possible. This may for instance be achieved by discharging the envelope at a low speed, for instance at a speed at which the envelopes are removed in an end to end relationship. Preferably however this object is achieved by interrupting the removal of the envelope at least once. Thus the envelope will be stationary for some time so that it can easily be inspected and, if necessary, intercepted.

For interrupting the removal of the envelope, preferably means are provided for interrupting the discharge of the envelope when it passes an inspection station in a portion of the exit track which is visible externally, so that the removal of the envelope can be periodically and automatically interrupted when the envelope is in a position that is visible externally.

To enable an envelope to be removed directly after inspection, the exit track is preferably designed to be open at the location of the inspection station in such a way that the envelope can be removed from the exit track 6.

The embodiments of the invention shown permit inspection and interception of the envelope when it is disposed at an inspection station along the exit track 6 owing to the fact that a portion of the exit track 6 is designed in the form of superjacent and subjacent belts 7 and 8 of resilient material for clamping an envelope between them.

An envelope disposed at the location of the relevant portion of the exit track 6 is visible through the superjacent belts 7. The envelope can easily be removed by hand from between the belts 7 and 8. The endless belts offer the further advantage that any part of the contents that happens to be removed along with the envelope is not separated from the envelope in an uncontrolled manner, which might lead to that part being lost.

The apparatus according to the invention may also comprise means for interrupting the discharge of the envelope when it passes an interception station provided downstream of the inspection station along the exit track, in which the exit track at least at the location of the interception station is open in such a way that the envelope can be taken from the exit track. Such an embodiment is advantageous for instance if the contents separated from the envelope inspected before the discharge of the corresponding envelope is completed. When the inspection of the contents reveals that the envelope should be added to it, for instance because the address of the sender is only provided on the envelope, that envelope can be removed from the exit track from such an interception station.

The interception station can also be used for intercepting envelopes which have not been separated completely from the corresponding contents. In such an embodiment of the invention the exit track need not be open at the inspection station, but the envelope can be intercepted after having been conveyed from the inspection station to the interception station.

In each of the embodiments shown an exit opening 9 for the contents is provided on an operating side 10 of the apparatus and the exit track 6 extends along the upper side of the apparatus, away from the operating side 10. This brings about the advantage that the apparatus occupies a small area. A further advantage is that on the one hand the exit track 6 extends within the field of vision of the operator so that he can readily observe whether any part of the contents is discharged along with an envelope 4, and, on the other hand, that empty envelopes are removed away from the operating side 10 so that they will not occupy any space on the operating side 10.

A compact configuration of the apparatus and a transport track through the apparatus with changes in direction that are easy to construct are further obtained in the embodiments shown. The station 3, 103 for separating the front wall and the rear wall along three of the folding edges is adapted for the postal item 2 to be fed to it from the operating side 10 and to be removed from it to the operating side 10 and the exit track 6 extends along the upper side of the station 3, 103 for severing the front wall and the rear wall along three of the folding edges.

In the embodiment shown in FIGS. 1 and 2 the station for severing the front wall and the rear wall along three of the folding edges has an opening 11 provided in it (see FIG. 2) for both feeding and removing the postal item 2, in front of which opening 11 a switch 12 is provided for guiding that postal item 2, when it is being transported to the station 5, 105 for separating the envelope 4 from its contents. Such a station for severing the front wall from the rear wall along three of the folding edges is known per se from U.S. Pat. No. 4,553,459.

On the operating side 10 of the switch a conveyor belt 40 for conveying the postal items to the switch is provided. A wall 65 inclined towards the conveyor belt 40 is arranged opposite the end of said conveyor belt that is remote from the switch 12. A pressing roller 41 can be pivoted approximately from the wall 65 to said end of the conveyor belt. The postal items are supplied in a substantially vertical position from the supply means 1. When a postal item is supplied, it is tilted towards the conveyor belt by the wall 65 inclined towards the conveyor belt 40. Then the postal item 2 is pressed against the conveyor belt by pivoting the pressing roller 41 towards the conveyor belt 40 so that it is lifted, tilted further and carried along by the conveyor belt.

The station 3 according to FIGS. 1 and 2 for separating from each other the front wall and the rear wall along three of the folding edges, comprises a cutting member 13 arranged along a guiding surface 14 having provided therein slots 15–18 of circular segment shape allowing sets of wheels 19–22 to extend through them and holes allowing rotationally symmetrical elements to extend through them. Each of the rotationally symmetrical elements can be rotated about its center line extending in a direction substantially parallel to the guiding surface 14, as well as about an axis transverse to the guiding surface 14, the rotation about the two axes being driven by driving means (not shown) arranged under the guiding surface 14. In the drawings the rotationally symmetrical elements are shown as circles 23. Viewed from the operating side 10, the guiding surface 14 is bounded by a left-hand edge 24, a guiding edge 25, a right-hand edge 26 and a front-most edge 27.

A postal item is preferably transported transversely along the left-hand edge 24 until it abuts the guiding edge 25. The transport up to the guiding edge 25 is driven by the rotationally symmetrical elements whose center lines are held in a position parallel to the guiding edge 25. After the postal item has reached the guiding edge 25 the rotationally symmetrical elements are rotated about the axis transverse to the guiding surface 14 until the center lines have reached a position transverse to the guiding edge 25. By this rotation of the center lines the direction of transport of the postal item is changed until it is oriented in a direction parallel to the guiding edge 25. Thus the postal item is transported along the guiding edge 25 and the cutting member 13. The cutting member comprises means for passing on the postal item (not shown). The postal item is cut open along the folding edge that is turned towards the guiding edge 25 while it is being passed along the cutting member 13.

After the postal item has been passed along the cutting member 13 it reaches the position indicated by 2A in the drawing and the wheels 19–22 are driven for returning the postal item 2 rotated through one-quarter turn. Thus the item passes the position designated by 2B in the drawing. At the same time the direction of rotation of the rotationally symmetrical elements is reversed. This can be effected by driving the elements in opposite direction or by rotating the elements through 180° about the corresponding axes transverse to the guiding surface 14.

When the postal item reaches the rotationally symmetrical elements again it is passed on to the position designated by 2C. From this position the postal item is transported again along the cutting member 13, cut open along a folding edge and then returned, rotated through one-quarter turn.

When the postal item is passed along the cutting member for the third time, no cutting operation is carried out. Thus it is realized that when the postal item, after subsequently being passed along the cutting member 13 once again (for the envelope to be cut open along its third folding edge) and being returned rotated through one-quarter turn, is transported in transverse direction to the station 5 for removing the envelope from its contents, the leading edge is formed by the folding edge that is not cut open.

According to the embodiment shown in FIG. 3 the station 103 for severing the front wall from the rear wall along three of the folding edges, comprises a rectangular guiding surface 114 having a left-hand guiding edge 28 viewed from the operating side 10, a rear guiding edge 29 and a right-hand guiding edge 30. The means for transporting a postal item along said guiding edges 28, 29 and 30 are designed as rotationally symmetrical elements of the same type as the rotationally symmetrical elements according to the embodiment shown in FIGS. 1 and 2. These rotationally symmetrical elements are shown as circles 123. Each of the guiding edges 28, 29 and 30 is provided with a cutting member 113 arranged substantially centrally and operating at some distance from the respective guiding edges for cutting open the envelope along a folding edge for the purpose of separating from each other the front wall and the rear wall of that envelope.

The station for cutting open an envelope along three folding edges has a supply opening 111 between the holder station 1 and the station 105 for removing the envelope 4 from its contents. In the area of this supply opening 111 transport rollers 31, 32 are arranged obliquely relatively to the left-hand guiding edge 28 so that postal items 2 upon being transported through the opening 111 are forced against the left-hand guiding edge 28.

When a postal item is fed through the supply opening 11 from a position designated by the reference numeral 2A, the rotationally symmetrical elements 123 are rotated, their center lines 31 being held in a position substantially transverse to the left-hand guiding edge 28. The center lines 31 may be held in a slightly oblique position with the right-hand side of each of the rotationally symmetrical elements being disposed at a greater distance from the operating side than the left-hand side, as shown in FIG. 3. Thus the postal item is continuously forced against the left-hand guiding edge 28. Upon passing the cutting member 113 provided along the left-hand guiding edge 28 the postal item is cut open along the folding edge of the envelope that is turned towards said left-hand guiding edge 28.

The postal item is transported along the left-hand guiding edge 28 until it abuts the rear guiding edge 29. The position in which the postal item has abutted the rear guiding edge 29 is designated by the reference numeral 2B in FIG. 3. Then the rotationally symmetrical elements 123 are rotated about corresponding axes transverse to the guiding surface 114 until the center lines 31 are in a position substantially transverse to the rear guiding edge 29. The center lines 31 of the rotationally symmetrical elements may be held in an oblique position relative to the rear guiding edge 29 in a similar way as described with reference to the left-hand guiding edge 28. Upon passing the cutting member 113 provided along the rear guiding edge 29 the envelope is cut open along the second folding edge turned towards said guiding edge 29.

When next the postal item abuts the right-hand guiding edge 30 the rotationally symmetrical elements are rotated about the corresponding axes transverse to the guiding surface 114 in a similar way as described with reference to the rear guiding edge 29. The position in which the postal item abuts the right-hand guiding edge 30 is designated by reference numeral 2C in FIG. 3. From that position the postal item is next passed along the right-hand guiding edge 30 to the station 105 for the envelope to be removed from the corresponding contents. Before reaching said station the envelope is cut open along the folding edge turned towards said guiding edge 30.

The station 103 for cutting open the envelope along three folding edges as shown in FIG. 3 offers the advantage that the U-shaped course of the transport path of the postal items permits a compact construction, particularly when the station 103 is adapted for removing the postal items to a station connecting to the operating side 10 for removing the envelope from its contents, which station in turn is adapted for feeding the contents to the operating side 10 and for removing the processed envelopes away from the operating side 10. A further advantage is that the distance between the edges along which the front wall and the rear wall of the envelope are separated, and the folding edge is independent of the size of the envelope. The size of the envelopes to be processed is only limited by the distance from the separation members 113 to the end of the guiding edge along which these are provided. A yet further advantage is that the station 103 has a large processing capacity on account of the fact that each postal item needs to be passed along each separation member 113 only once.

For the means for transporting the envelope along the guiding edges various alternatives are conceivable, for that matter. These means could for instance comprise three separate transporting means each corresponding with one of the guiding edges, which transporting means can each be separately operated for engagement with the envelope in the order corresponding with the direction of transport.

FIG. 2 shows an embodiment of a station 5, 105 for removing an envelope from its contents. The station 5, 105 has a supply opening 47 through which a transport path extends defined by supply rollers 52, 53 and supply guides 54 and 55. Further the station 5, 105 has an exit opening 9 provided in it on the operating side 10 for removing processed contents and an exit opening 49 provided at the top for removing processed envelopes. The exit track for the contents is defined by a conveyor belt 43 and an exit roller 44. The removal path for the envelope is defined by removing rollers 51 and 52 and guides 56 and 57.

The means for removing the envelope from the contents comprise a superjacent vacuum roller 34 and a subjacent vacuum roller 35, which can both be driven at the same peripheral velocity, facing portions of the circumferential surfaces 38 and 39 of the rollers 34 and 35, respectively, being moved in the direction of the exit opening 9. The circumferential surfaces 38 and 39 are air-permeable. Provided in the rollers 34, 35 are means (not shown) for generating a vacuum behind a sector of each of the circumferential surfaces 38, 39. The circumferential surface 39 of the subjacent vacuum roller 35 has a lower coefficient of friction relative to the envelope than the circumferential surface 38 of the superjacent vacuum roller. Provided substantially diametrically opposite the subjacent vacuum roller 35 is a trailing pressing roller 42 engaging the circumferential surface 38 of the superjacent vacuum roller 34.

Provided on the removal side of the vacuum rollers 34 and 35 in the vicinity of the lower side of the subjacent vacuum roller 35 is the conveyor belt 43. In the vicinity of the end of the conveyor belt 43 remote from the vacuum rollers 34 and 35, the exit roller 44 engages the conveyor belt 43.

The operation of the station 5, 105 for removing an envelope from its contents will now be explained.

The postal item 2 is supplied from the station 3, 103, the postal item 2 being so oriented that the edges along which the front wall and the rear wall of the envelope 4 are cut loose form the leading edge and the side edges connected thereto. When the envelope is fed between the vacuum rollers 34, 35, the front wall and the rear wall follow the curve of the circumferential surface 38, 39 of the relevant vacuum roller 34, 35, while the contents due to their bending stiffness and possibly supported by air resistance are passed through at the plane of the nip between the rollers 34 and 35. The contents are then carried along by the conveyor belt 43 as far as between the conveyor belt 43 and the exit roller 44. When the trailing edge leaves the area between the vacuum rollers 34, 35, one of the walls of the envelope will in the meantime have entered the area between the pressing roller 42 and the vacuum roller 34 so that a greater force can be exerted on that wall than on the other wall. As a result the other wall 46 will be drawn off the subjacent vacuum roller 35 and can be removed to the removal opening 49 along with said one wall. From the removal opening the envelope is further carried off along the exit track 6.

In particular it is observed that the envelope is transferred to the exit track in an unfolded position such at its former inner sides are directed away from the apparatus when the envelope is being removed along the exit track 6. The invention is not limited to the above described manner of achieving this effect. For instance, it is also possible to remove the envelope from its contents by sliding a portion of the one wall of the envelope relatively to the other wall in the direction of the folding edge along which the two walls are still connected until said one wall pivots about the folding edge of the other wall. Then the contents can be slid over said folding edge and off the pivoted one wall of the envelope.

The two embodiments shown in FIGS. 1 and 2 and in FIG. 3 comprise one and the same holder station 1 for supplying postal items 2 piece by piece. The holder station 1 comprises a storing space 58 in which the postal items to be processed can be placed. Mounted in the storing space is a hold-down support 59 for sliding movement along a guiding slot 60. The hold-down support 59 is connected with means (not shown) for pushing the stack of postal items 2 to be processed to the operating side 10. Provided on the operating side 10 of the storing space 58 are a support roller 61 and a supply roller 62. Further, on the operating side 10 on the side of the station 3 for separating from each other the front wall and the rear wall of an envelope along three of the folding edges, a transport roller 63 and a separation roller 64 are mounted with the transport roller 63 being arranged on the operating side 10 relatively to the separation roller 64. The separation roller 64 is spring biased in the direction of the transport roller 63 and can be driven for returning in the direction of the storing space 68 a postal item that has been carried along with an outer postal item. Further the separation roller 64 is coupled with a slip clutch set in such a way that the separation roller 64 is driven via its circumferential surface when less than two postal items 2 are disposed between the separation roller 64 and the transport roller 63.

For a stack of postal items to be processed the hold-down support 59 is moved away from the operating side 10 and the stack of postal items 2 is horizontally placed between the hold-down support 59 and the supply rollers 61 and 62 so that the envelopes are in a line one behind the other in substantially upright position. Then the hold-down support 59 is pressed against the stack of postal items 2 for exerting a press-on force on the stack in the direction of the operating side 10. When the apparatus is operated for processing a postal item the supply roller 62 and the transport roller 63 are actuated. Further, the separation roller 64 is driven, but it travels along with the transport roller 63 as long as no more than one postal item 2 is disposed between the separation roller 64 and the transport roller 63.

Through the action of the supply roller 62 the outermost postal item on the operating side 10 of the stack is moved towards the transport roller 63 which carries the postal item along upon engagement with it. After the transport roller 63 engages the outermost postal item the drive of the supply roller 62 is disengaged. Any following postal items that are carried along by the outermost postal item are restrained by the separation roller 64 and upon entering the area between the transport roller 63 and the separation roller 64 are returned to storing space 58 by the separation roller 64.

The outer-most postal item is transported by the transport roller 63 to be arranged before a wall 65, 165 on the operating side 10 of the station 3, 103 for separating from each other the front wall and the rear wall of an envelope. Then the postal item can be tilted off said wall 65, 165 for the item to assume a horizontal position on the guiding surface 14, 114. From this horizontal position the postal item can be further transported to the station 3, 103 for separating from each other the front wall and the rear wall of an envelope.

We claim:

1. An apparatus for removing contents from an envelope having a front wall and a rear wall connected to said front wall along four folding edges, said front wall and said rear wall having first surfaces that face one another, said apparatus comprising:

means for severing said front wall from said rear wall along three of the folding edges;

means for separating the envelope from its contents; and an exit track for removing the separated envelope, the exit track passing along an outer side of the apparatus and being at least in part externally visible;

said means for separating the envelope from its contents including means for unfolding said front envelope wall from said rear envelope wall and means for transferring the envelope to said exit tract in an unfolded condition and in a position from which the envelope can be transported along the exit track with the first surfaces of the envelope walls turned away from the apparatus.

2. Apparatus according to claim 1, comprising an externally visible inspection station in a portion of the exit track and means for interrupting the discharge of an envelope at said inspection station.

3. Apparatus according to claim 2, wherein at least at the inspection station the exit track is open so as to enable the envelope to be taken from the exit track.

4. Apparatus according to claim 2, comprising an interception station downstream of the inspection station and means for interrupting the discharge of the envelope at the interception station, the exit track being open at the interception station so as to enable the envelope to be taken from the exit track.

5. Apparatus according to claim 2, comprising an exit opening for the contents of the envelope, said exit opening being provided on an operating side of the apparatus, and the exit track extending along the upper side of the apparatus away from the operating side.

6. Apparatus according to claim 5, wherein the means for severing the front wall from the rear wall along three of the folding edges have an inlet and an outlet for feeding an envelope from the operating side and discharging the envelope to the operating side and that the exit track extends along the upper side of said severing means.

7. Apparatus according to claim 6, wherein the means for severing the front wall from the rear wall along three of the folding edges comprise a single envelope feeding and discharge opening, in front of which opening a switch is provided for guiding severed envelopes to said means for separating the envelope from its contents.

8. Apparatus according to claim 6, wherein the means for separating the front wall from the rear wall along three of the folding edges comprise three guiding edges provided along a rectangular plane and means for transporting an envelope along said guiding edges, and each of said guiding edges comprises substantially centrally located severing means acting at a small distance from the guiding edge for severing the front wall from the rear wall of the envelope along a folding edge of that envelope.

9. Apparatus as claimed in claim 7, further comprising means for transporting the envelope along a plurality of guiding edges, said transporting means including at least one driven rotationally symmetrical element whose axis of rotation can be rotated about an axis transverse to said first wall.

10. Apparatus according to claim 8, wherein the means for transporting an envelope along the guiding edges comprise at least three separate transporting means each corresponding with one of the guiding edges and each separately to engage the postal item in an order corresponding with the direction of transport.

11. Apparatus according to claim 8, wherein the means for transporting an envelope along the guiding edge(s) comprise at least one driven rotationally symmetrical element whose axis of rotation can be rotated about an axis transverse to said rectangular plane.

12. A method for removing contents from an envelope by means of an envelope extraction apparatus, said envelope having a front wall and a rear wall interconnected along four folding edges, said front wall and said rear wall having first surfaces that face one another, said method comprising the steps of:

severing said front wall from said rear wall along three of the folding edges;

mechanically separating the envelope from its contents;

unfolding the front envelope wall from the rear envelope wall; and removing the envelope along an exit track in an unfolded condition and in an orientation in which the first surfaces of the envelope walls being turned away from the envelope extraction apparatus.

13. A method according to claim 12, wherein said severing step further comprises the steps of:

passing a first folded edge of the envelope along a severing device;

rotating the envelope about an axis transverse to a plane of the envelope;

passing a second folded edge of the envelope along the severing device;

rotating said envelope about an axis transverse to the plane of the envelope again; and passing a third folded edge of the envelope along the severing device.

14. A method according to claim 12, wherein the severing step further comprises transporting three folded edges of the envelope along successive severing devices, the front wall of the envelope being severed from the rear wall along each folded edge during said transporting of the envelope along the respective severing devices.

15. A method according to claim 12, including the step of interrupting the removing step.

16. An apparatus for removing contents from an envelope having a front wall and a rear wall connected to said front wall along four folding edges, said apparatus comprising:

means for severing said front wall from said rear wall along three of the folding edges;

an exit track for removing the separated envelope, said exit track passing along an outer side of the apparatus and being at least in part externally visible;

means for separating the envelope from its contents including means for unfolding said front envelope wall from said rear envelope wall and means for transferring the envelope to said exit track in an unfolded condition and in a position from which the envelope can be transported along the exit track with inner surfaces of the envelope walls turned away from the apparatus; and an exit opening for removing the separated contents of the envelope, said exit opening being provided on an operating side of the apparatus and said exit track extending along an upper side of the apparatus away from the operating side.

17. An apparatus according to claim 16, further comprising an externally visible inspection station in a portion of the exit track and means for interrupting a discharge of an envelope at said inspection station.

18. An apparatus according to claim 17, wherein at least at the inspection station the exit track is open so as to enable the envelope to be taken from the exit track.

19. An apparatus according to claim 17, further comprising an interception station downstream of the inspection station and means for interrupting the discharge of the envelope at the interception station, the exit track being open at the interception station so as to enable the envelope to be taken from the exit track.

20. An apparatus according to claim 16, wherein the means for severing the front wall from the rear wall along three of the folding edges includes an inlet for feeding an envelope from the operating side and an outlet for discharging the envelope to the operating side and wherein the exit track extends along an upper side of said severing means.

21. An apparatus according to claim 20, wherein the means for severing the front wall from the rear wall along three of the folding edges includes a single envelope feeding and discharge operating, in front of which opening a switch is provided for guiding severed envelopes to said means for separating the envelope from its contents.

22. An apparatus according to claim 20, wherein the means for separating the front wall from the rear wall along three of the folding edges includes three guiding edges provided along a rectangular plane and means for transporting an envelope along said guiding edges, each of said guiding edges including substantially centrally located severing means acting at a small distance from the guiding edge for severing the front wall from the rear wall of the envelope along a folding edge of the envelope.

23. An Apparatus as claimed in claim 21, further comprising means for transporting the envelope along a plurality of guiding edges, said transporting means including at least one driven rotationally symmetrical element whose axis of rotation can be rotated about an axis transverse to said first wall.

24. An apparatus according to claim 22, wherein the means for transporting an envelope along the guiding edges includes at least three separate transporting means each corresponding to one of the guiding edges so as to separately engage the envelope in an order corresponding with the direction of transport.

25. An apparatus according to claim 22, wherein the means for transporting an envelope along the guiding edges includes at least one driven rotationally symmetrical element whose axis of rotation can be rotated about an axis transverse to said rectangular plane.

* * * * *